United States Patent [19]

Schirk et al.

[11] 4,408,891

[45] Oct. 11, 1983

[54] ARRANGEMENT FOR DEVELOPING PHOTOGRAPHIC LAYER CARRIERS

[75] Inventors: Günter Schirk; Alfons Kastl, both of Munich, Fed. Rep. of Germany

[73] Assignee: Agfa-Gevaert AG, Leverkusen, Fed. Rep. of Germany

[21] Appl. No.: 283,671

[22] Filed: Jul. 15, 1981

[30] Foreign Application Priority Data

Jul. 31, 1980 [DE] Fed. Rep. of Germany ..... 3029044

[51] Int. Cl.[3] ..... B01F 5/12; B01F 13/08

[52] U.S. Cl. ..... 366/265; 366/166; 417/420

[58] Field of Search ..... 366/137, 136, 273, 279, 366/262, 263, 166, 266, 267, 270, 265; 417/420

[56] References Cited

U.S. PATENT DOCUMENTS

| | | | |
|---|---|---|---|
| 3,481,586 | 12/1969 | Roberts | 366/274 |
| 3,730,488 | 5/1973 | Gardner | 366/262 |
| 4,152,099 | 5/1979 | Bingler | 417/420 |

*Primary Examiner*—Robert W. Jenkins
*Attorney, Agent, or Firm*—Michael J. Striker

[57] ABSTRACT

An arrangement for developing photographic layer carriers has at least one container for accommodating a treating medium and having an uninterrupted wall, a pump for circulating the treating medium in the container and having a first part formed by the uninterrupted wall of the container and a second part associated with the first part, and a magnetic force-transmitting element located outside the container and magnetically acting upon a rotary body of the pump so as to rotate the same.

18 Claims, 2 Drawing Figures

ARRANGEMENT FOR DEVELOPING PHOTOGRAPHIC LAYER CARRIERS

BACKGROUND OF THE INVENTION

The present invention relates to arrangements for developing photographic layer carriers. More particularly, it relates to arrangements for developing photographic layer carriers, which have at least one container with a treating medium and a pump located inside the container and driven from outside of the container so as to pump the developing medium for circulation purposes.

Arrangements of the above-mentioned general type are known in the art. In the known developing arrangements or machines, the bath agitation is always performed by rotating the developing medium with the aid of a pump. The developing medium is withdrawn via an external conduit in which the pump is arranged through the bottom of the container, and then introduced into the container at a predetermined location. Another developing arrangement is also known from German Pat. No. 862,560. In this arrangement, the pump is located inside the container and is in a driving connection with an outside drive via a shaft extending from inside outwardly of the container. Such a construction has, however, a considerable disadvantage in the fact that the passage for the above-mentioned shaft in the container wall often becomes untight after a short time. As a result of this, the aggressive treating medium can escape from the container. Taking this into consideration, such arrangements are provided with complicated or expensive devices with external pumps.

SUMMARY OF THE INVENTION

Accordingly, it is an object of the present invention to provide an arrangement for developing photographic layer carriers, which avoids the disadvantages of the prior art.

More particularly, it is an object of the present invention to provide an arrangement for developing photographic layer carriers, in which sealing problems do not take place.

In keeping with these objects, and with others which will become apparent hereinafter, one feature of the present invention resides, briefly stated, in an arrangement for developing photographic layer carriers which has at least one container for accommodating a treating medium and having an uninterrupted wall, means for circulating the treating medium in the container and including a pump with a first part formed by the uninterrupted wall of the container, a second part associated with the first part, and a rotary body, and magnetic means for imparting rotation to the rotary body of the pump, wherein the magnetic means is located outside of the container and magnetically acts upon the rotary body of the pump to rotate the same.

When the arrangement is designed in accordance with the present invention, the container of the arrangement is completely tight. It is formed in correspondence with the bottom so that the pump is lowered into the bottom and does not disturb the transport movement of the layer carriers whereby the container can also be very small. When the arrangement is designed in accordance with the present invention, the cleaning expenses are very low, and the mounting and servicing of the arrangement is relatively simple.

In accordance with another feature of the present invention, the wall of the container has an outwardly extending portion which surrounds a first magnetic element of the rotary body of the pump and is in turn surrounded by a second magnetic element of the force-imparting element of the magnetic means.

In accordance with a further advantageous feature of the present invention, the wall of the container is provided with holding means for holding a housing of the force-transmitting element, and a retaining means for retaining a housing of the pump. The holding means and the retaining means may be formed as snapping means or spring means, respectively.

The arrangement may include several containers with circulating means and magnetic means, wherein the latter is driven from a common electric motor through a motion-transmitting element formed as a chain or a toothed belt.

Finally, the transmission of the motion to the force-transmitting element may be performed by gears mounted on the force-transmitting element and having different diameters in accordance with desired outputs of the pump for circulating the treating medium in a respective one of the containers.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

DESCRIPTION OF THE PREFERRED EMBODIMENTS

Figure 1:
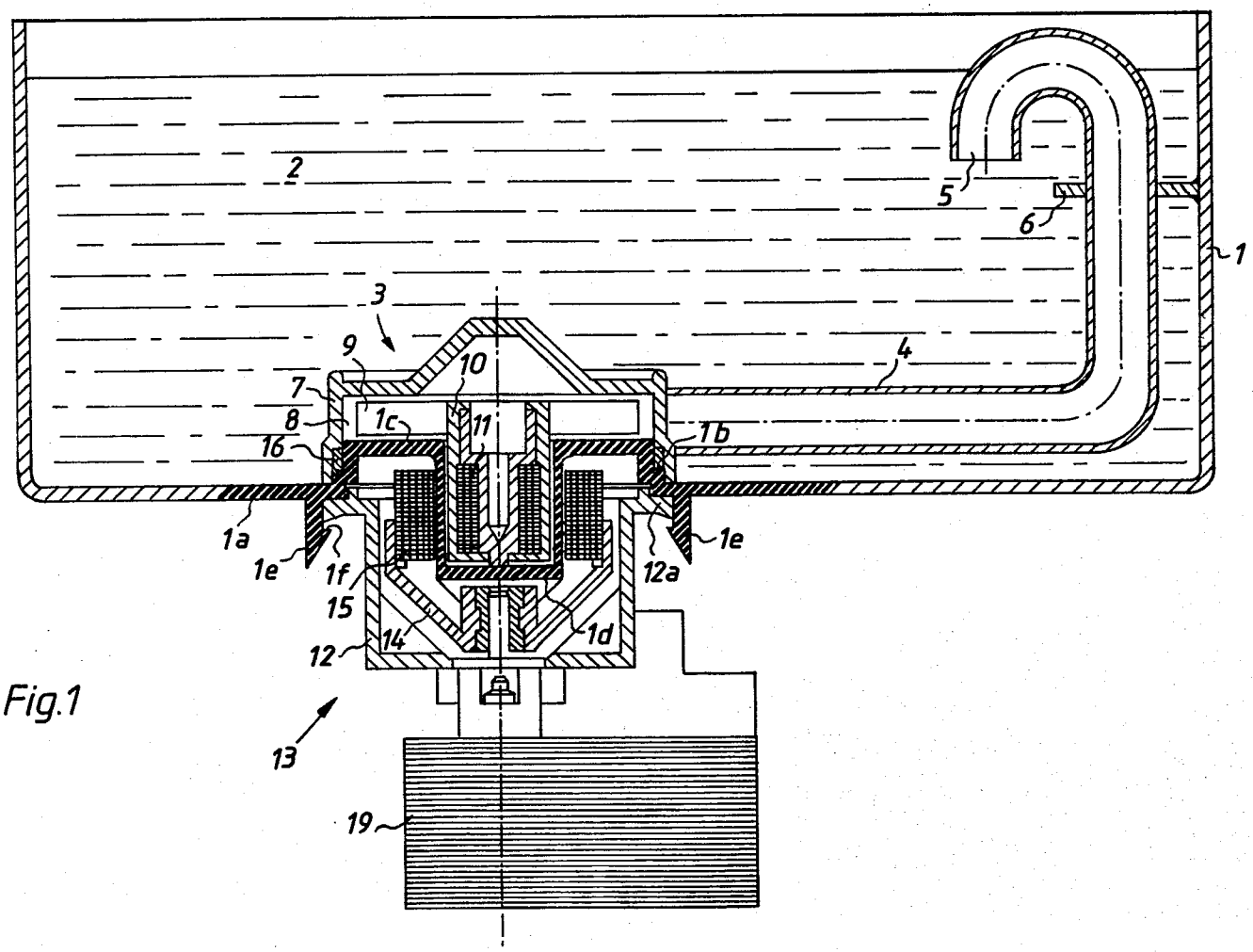
FIG. 1 is a view showing a section of an arrangement for developing photographic layer carriers in accordance with the present invention.

An arrangement for developing photographic layer carriers shown in FIG. 1 has a container 1 which is filled with a developing medium such as a treating liquid 2. The container 1 has a bottom wherein a pump 3 is arranged. The pressure side of the pump 3 opens into a pipe 4. The pipe 4 extends from the bottom of the container 1 upwardly and then is curved downwardly. At the end of the pipe 4, it has an opening facing toward the body of the liquid 2. The pipe 4 is mounted with the aid of a bracket 6 on a lateral wall of the container 1.

The bottom 1*a* of the container 1 is formed in accordance with the present invention as an uninterrupted bottom. The bottom 1*a* is formed so that it can receive the pump 3 at its one side and receive a magnetic drive for the pump at the other side. For improved identification, the bottom is hatched in black. The bottom 1*a* has an inwardly extending ring-shaped shoulder 1*b* formed so that a housing 7 of the pump 3 abuts against this shoulder. An inner ring-shaped raised portion 1*c* follows the shoulder 1*b*. The raised portion 1*c* forms a lateral wall of a pump chamber 8. An impeller 9 of the pump 3 rotates inside the pump chamber 8.

The ring-shaped raised portion 1*c* is connected with a cylindrical outwardly extending depression 1*d* which extends downwardly beyond the main part of the bottom 1*a*. The depression 1*d* serves for recieving a rotary body 10 of the pump, on which the impeller 9 is mounted. An annular magnet 11 is arranged inside the rotary body 10 and located substantially in the region of the cylindrical depression 1*d*.

The bottom 1*a* has a plurality of projections 1*e* which are arranged at the outer side of the bottom in a circular manner and have inwardly extending beads 1*f*. The projections 1*e* are elastic and serve for receiving a housing 12 of a force-transmitting element 13. A rotary member 14 is rotatably arranged on the force-transmitting element 13. The rotary member 14 has a shaft connected with a motor 19. An annular magnet 15 is arranged in the rotary member 14 and closely surrounds the outer wall of the cylindrical depression 1*d*. The annular magnet 15 is located in the region of the inner magnet 11.

For mounting, it is necessary to fit the pump 3 with its housing 7 onto the shoulder 1*b*, and the spring elements provided between the housing 7 and the bottom 1*a* reliably hold the pump. From outside, the force-transmitting element 13 is fitted over the cylindrical depression 1*d*, whereas a flange 12*a* of the housing 12 engages behind the bead 1*f* of the elastic projections 1*e*. Finally, the motor 19 is placed onto the force-transmitting element 13.

In operation, the motor drives the rotary member 14 in rotation, whereby the annular magnet 15 takes along in rotation the inner magnet 11 on the rotary body 10 of the pump 3. Thereby the pump 3 arranged above the bottom 1*a* acts upon the aspirated liquid through the pipe 4 toward the discharge opening 5 in the direction to the upper side of the container 1, whereby the liquid is urged for rotation and circulation.

Because of the integration of the bottom of the container into the pump, it has a special shape which can be produced as a synthetic plastic molded part in a relatively simple way. Such an arrangement is absolutely fluid-tight. For cleaning purposes, the pump 3 as well as the force-transmitting element can be removed from the bottom 1*a* of the container 1 with the aid, for example, of the same handle.

It is to be understood that the arrangement may be mounted not only on the bottom of the container 1, but instead on a lateral wall of the container or at any other location.

Figure 2:
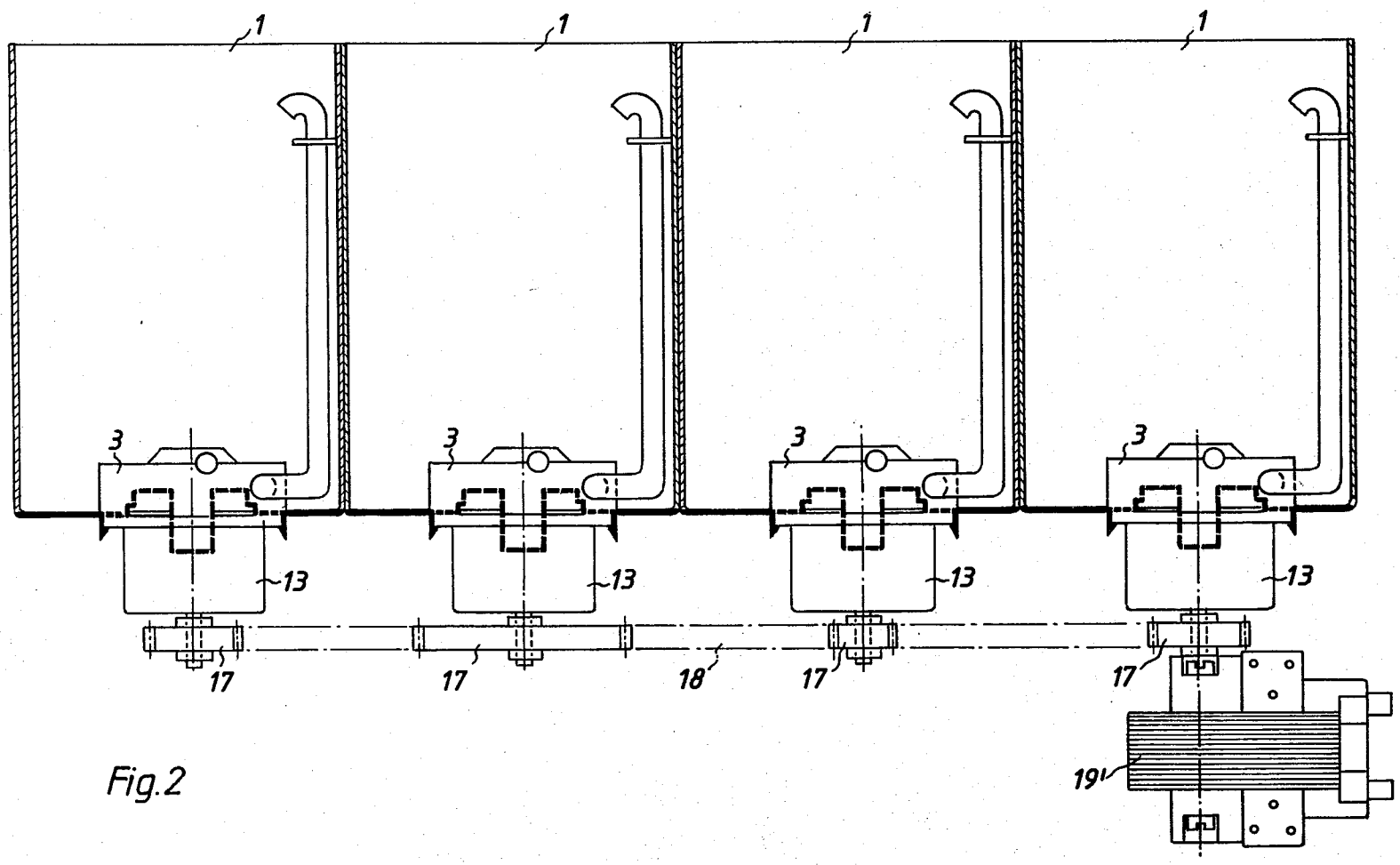
FIG. 2 is a view showing a cross section of the arrangement including several developing containers.

As can be seen from FIG. 2, the arrangement may have several containers for accommodating a treating medium which are arranged adjacent to one another, each provided with the pump 3 and the force-transmitting element 13. The arrangement has a common drive 19'. In order to drive the force-transmitting element 13 from the common drive (the electric motor) 19', each force-transmitting element 13 is provided with a gear 17, and all gears 17 are connected with one another by a chain or a toothed belt 18. Thereby, each gear 17 is in connection with the drive motor 19'.

The arrangement shown in FIG. 2 may be designed so as to provide different outputs from the pump arranged in the various containers. This can be advisable when the containers are utilized for various purposes or have different dimensions. In this case, the gears 17 associated with the pump 3 in various containers have different diameters so as to provide for different motion-transmitting ratios.

It will be understood that each of the elements described above, or two or more together, may also find a useful application in other types of constructions differing from the types described above.

While the invention has been illustrated and described as embodied in an arrangement for developing photographic layer carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. An arrangement for developing photographic layer carriers, comprising at least two containers each for accommodating a treating medium and having an uninterrupted wall; means for circulating the treating medium in each of said container and including a pump which has a first part formed by said uninterrupted wall of each of said containers and a second part associated with said first part, said pump having a rotary body located inside each of said containers; magnetic means for each of said containers and imparting rotation to said rotary body of each of said pumps, said magnetic means being located outside each of said containers and magnetically acting upon said rotary body of each of said pumps so as to rotate the same, said magnetic means including a driven magnetic force-transmitting element located outside each of said containers and acting upon said rotary body of each of said pumps; and common means for driving the force-transmitting elements of both magnetic means for both said circulating means of both said containers, said driving means including a gear provided on each of said force-transmitting elements, an electric motor, and a motion-transmitting element arranged between said electric motor and the gears of both said force-transmitting elements and rotating both said gears and thereby both said force-transmitting elements.

2. An arrangement as defined in claim 1, wherein said rotary body of each of said pumps is provided with a first magnetic element, said wall of each of said containers having an outwardly extending portion, and each of said force-transmitting elements having a second magnetic element which surrounds said portion of said wall of each of said containers and acts upon said first magnetic element of said rotary body of each of said pumps.

3. An arrangement as defined in claim 2, wherein said portion of said wall of each of said containers is cylindrical.

4. An arrangement as defined in claim 3, wherein said first magnetic element of said rotary body of each of said pumps is surrounded by said portion of said wall of each of said containers.

5. An arrangement as defined in claim 2, wherein each of said force-transmitting elements has a housing, said portion of said wall of each of said containers having holding means for holding said housing of said force-transmitting element with snap action.

6. An arrangement as defined in claim 5, wherein said holding means includes elastic holding projections provided on said portion of said wall of each of said containers and engaging with said housing of said force-transmitting element with snap action.

7. An arrangement as defined in claim 1, wherein each of said pumps has a housing formed by said second part; and further comprising retaining means provided on said wall of each of said containers and arranged for retaining said housing of said pump.

8. An arrangement as defined in claim 1, wherein said motion-transmitting element of said driving means includes a chain.

9. An arrangement as defined in claim 8, wherein said gears of said force-transmitting elements have different diameters in correspondence with desired outputs of said pumps for circulating the treating medium in a respective one of said containers.

10. An arrangement as defined in claim 1, wherein said motion-transmitting element of said driving means includes a toothed belt.

11. An arrangement for developing photographic layer carriers, comprising at least one container for accommodating a treating medium and having an uninterrupted wall with a wall projection; means for circulating the treating medium in said container and including a pump which has a first part formed by said uninterrupted wall of said container and a second part associated with said first part and forming a housing, said pump having a rotary body located inside said container; magnetic means for imparting rotation to said rotary body of said pump, said magnetic means being located outside said container and magnetically acting upon said rotary body of said pump so as to rotate the same; and retaining means providing on said wall of said container and arranged for retaining said housing of said pump, said retaining means including spring elements provided on said wall projection of said wall of said container and engaging with said housing of said pump.

12. An arrangement as defined in claim 11, wherein said magnetic means for imparting rotation to said rotary body of said pump includes a driven magnetic force-transmitting element located outside said container and acting upon said rotary body of said pump.

13. An arrangement as defined in claim 12, and further comprising at least one second such container with at least one second such circulating means and with at least one second such magnetic means also including one such driven magnetic force-transmitting element, and common means for driving the force-transmitting elements of both magnetic means for both said circulating means of both said containers.

14. An arrangement as defined in claim 11, wherein said rotary body of said pump is provided with a first magnetic element, said wall of said container having an outerwardly extending portion, and said force-imparting element having a second magnetic element which surrounds said portion of said wall of said container and acts upon said first magnetic element of said rotary body of said pump.

15. An arrangement as defined in claim 14, wherein said portion of said wall of said container is cylindrical.

16. An arrangement as defined in claim 15, wherein said first magnetic element of said rotary body of said pump is surrounded by said portion of said wall of said container.

17. An arrangement as defined in claim 15, wherein said holding means includes elastic holding projections provided on said portion of said wall of said container and engaging with said housing of said force-transmitting element with snap action.

18. An arrangement as defined in claim 14, wherein said force-transmitting element has a housing, said portion of said wall of said container having holding means for holding said housing of said force-transmitting element with snap action.

* * * * *